US009581407B2

(12) United States Patent
Yi et al.

(10) Patent No.: US 9,581,407 B2
(45) Date of Patent: Feb. 28, 2017

(54) COMPOUND BOW TO ADJUST DRAW LENGTH

(71) Applicant: WIN & WIN Co., Ltd., Gyeonggi-do (KR)

(72) Inventors: Chang Ho Yi, Incheon (KR); Dong Won Park, Seoul (KR)

(73) Assignee: WIN & WIN Co., Ltd. (KR)

( * ) Notice: Subject to any disclaimer, the term of this patent is extended or adjusted under 35 U.S.C. 154(b) by 0 days.

(21) Appl. No.: 15/050,648

(22) Filed: Feb. 23, 2016

(65) Prior Publication Data

US 2016/0245611 A1 Aug. 25, 2016

(30) Foreign Application Priority Data

Feb. 23, 2015 (KR) ..... 10-2015-0025250

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105
See application file for complete search history.

(56) References Cited

U.S. PATENT DOCUMENTS 5,960,778 A * 10/1999 Larson ..... F41B 5/10 124/25.6
6,691,692 B1 * 2/2004 Adkins ..... F41B 5/10 124/25.6
7,082,937 B1 * 8/2006 Land ..... F41B 5/105 124/25.6
7,188,615 B2 3/2007 Chang
8,205,607 B1 * 6/2012 Darlington ..... F41B 5/105 124/23.1
8,739,769 B1 * 6/2014 Obteshka ..... F41B 5/10 124/23.1
9,121,658 B1 * 9/2015 Darlington ..... F41B 5/105
9,347,730 B2 * 5/2016 Obteshka ..... F41B 5/105
2013/0068206 A1 * 3/2013 Langley ..... F41B 5/1434 124/25.6

FOREIGN PATENT DOCUMENTS

KR 101418312 B1 7/2014

* cited by examiner

*Primary Examiner* — John Ricci
(74) *Attorney, Agent, or Firm* — Berenato & White, LLC

(57) ABSTRACT

Provided is a compound bow comprising: a bow main body; upper and lower pulley assemblies; a bowstring; and first and second cam cables, wherein at least one of the first and second cam cables is coupled to the fixing projection that moves along as a cam module moves, is wound on a cam cable winding portion via a compensation projection, and then extends toward the other side pulley assembly, and a front portion of the cam module is in contact with the one cam cable and thus the one cam cable is bent when the cam module is moved, to thus release the one cam cable from the cam cable winding portion via the compensating projection from the fixing projection that the one cam cable is coupled, to thereby maintain constant tension of the cam cable and keep the power of the bow.

4 Claims, 8 Drawing Sheets

COMPOUND BOW TO ADJUST DRAW LENGTH

CROSS-REFERENCE TO RELATED APPLICATION

This application claims the benefit of Korean Patent Application No. 10-2015-0025250, filed on Feb. 23, 2015, in the Korean Intellectual Property Office, the disclosure of which is incorporated in its entirety herein by reference.

FIELD OF THE INVENTION

The present invention relates to a compound bow, and more particularly, to a compound bow which can adjust draw-length of let-off of the compound bow.

BACKGROUND OF THE INVENTION

Typically, compound bows are configured so that a bowstring is easily pulled without using a large force and arrow shooting power is increased during shooting, by using an effect of a cam or wheel, to thus result in a fast speed of an arrow and have very strong power, and are widely used mainly for hunting.

When users having different arm's reaches use an identical compound bow, it is necessary to adjust a draw length of a bowstring in a let-off state, that is, in the latest state immediately before an arrow is launched. Otherwise, when a user is skilled in comparison with a beginner time, there may be the need to increase the draw length of the bowstring. A structure of a compound bow (Korean Patent No. 10-1418312, published on Jul. 10, 2014) proposed by the present applicant in order to easily adjust the pulling length of the bowstring in the let-off state is shown in FIGS. 1-3.

FIG. 1 is a perspective view of a conventional compound bow. FIG. 2 is a plan view of a pulley assembly coupled to a lower limb in FIG. 1. FIG. 3 is a plan view showing a pivoted state of a cam module in the compound bow of FIG. 1.

Referring to FIGS. 1 to 3, a compound bow includes: a bow main body 100 including a pair of limbs 103 that are respectively coupled to both ends of a handle 102; upper and lower pulley assemblies 107 and 108 that are respectively coupled to the rear end of each limb 103; a bowstring 140; cam cables 150 that are wound around a cam 200 of each of the upper and lower pulley assemblies as the bowstring 140 is pulled.

The bow main body 100 includes a handle 102 at a central portion of which a grip portion is formed so as to be gripped by a user, and a pair of limbs 103 that are respectively coupled to both ends of the handle 102 in which two branches are formed at the rear portion of each limb 103. A rotating shaft 101 is formed at the rear end of each limb 103, in which a pulley assembly is rotatably coupled on the rotating shaft 101 between the two branches at the rear end of each limb 103.

Each of the upper and lower pulley assemblies is rotatably coupled to the rotating shaft 101 at the rear end of each limb 103, and includes: a pulley 110 that is rotatably coupled to the rotating shaft 101 formed at the rear end of each limb 103; and a cam 200 coupled to one side of the pulley 110 and rotating with the pulley 110.

Each pulley 110 is formed of an oval-like plate-shaped member, and has an eccentric through-hole that is formed at the center of the pulley 110 and through which the rotating shaft 101 is coupled. A fixing protrusion 111 for fixing one end of the bowstring 140 wound on the guide groove is formed at one side of each pulley 110. In addition, fixing protrusions 112 and 113 are formed in each pulley 110 in which the cam cables 150 are fixed to the fixing protrusions 112 and 113, respectively. The bowstring 140 is wound in the guide groove of the pulley 110 of each pulley assembly and thus both ends of the bowstring 140 are coupled to the fixing protrusions 111 formed on the respective pulleys 110.

The cam cables 150 are formed between a pair of the limbs 103 of the bow main body 100 and are wound on the cams 200 formed in the respective pulleys 110, as the bowstring 140 is pulled. One end of each of the cam cables 150 is coupled to the fixing protrusion 113 formed on the pulley 110 of one of the pulley assemblies, and then is wound around the rotating wheel 120 that is rotatably coupled to the rotating shaft 101, to then be extended toward the other one of the pulley assemblies, and the other end of each of the cam cables 150 is fixed to the fixing protrusion 112 of the pulley 110 of the other one of the pulley assemblies. Therefore, as the bowstring 140 is pulled, the cam cables 150 are wound on the cam 200 that is coupled to the other pulley 110 of the pulley assemblies.

The cam 200 is formed in each pulley 110 and is rotated with rotation of the pulley 110, and includes: a cam cable support portion 210 fabricated in an arc-shaped form and on which one of the cam cables 150 is wound; and a cam module 220 that has a pivot shaft 221 at a position spaced by a predetermined distance from the rotating shaft 101 of the pulley 110 to which the cam 200 is coupled, and that is rotatably coupled to the pivot shaft 221 by a predetermined angle from the cam cable winding portion 210, in which a cam cable winding groove is formed on the outer circumferential surface of the cam module 220, and the one of the cam cables 150 is wound around the cam cable support portion 210 and then sequentially wound on the outer circumferential surface of the cam module 220 when the bowstring 140 is pulled.

The cam module 220 has the pivot shaft 221 at a position spaced by a predetermined distance from the rotating shaft 101 of the pulley 110 to which the cam 200 is coupled, and is rotatably coupled to the pivot shaft 221 by a predetermined angle from the cam cable support portion 210, and is configured to have a gentle slope portion 222 formed of a gentle arc-shaped curve and a steep slope portion 223 that is extended from the gentle slope portion 222 to be close to the rotating shaft 101, to thus form a steep slope. Further, the cam cable winding grooves on which the cam cables 150 are wound are formed on the outer circumferential surfaces of the gentle slope portion 222 and the steep slope portion 223. Accordingly, the cam module 220 is rotated along with the pulley 110 when the bowstring 140 is pulled, and thus the cam cables 150 are sequentially wound on the gentle slope portion 222 and the steep slope portion 223 of the cam module 220 adjacent to the cam cable support portion 210. In addition, the cam 200 further includes a fixing unit that makes the cam module 220 rotated by a predetermined angle with respect to the pivot shaft 221 in order to control the draw length of the let-off state of the compound bow, and that makes the cam module 220 fixed to the pulley 110 at a position where the cam module 220 has been rotated.

The fixing unit makes the cam module 220 fixed to the pulley 110 at a position where the cam module 220 has been rotated. To this end, an arc-shaped positioning hole 230 centered at the pivot shaft 221 is formed in the cam module 220, and a coupling hole (not shown) is formed in the pulley 110 to which the cam module 220 is coupled. Thus, when the cam module 220 is rotated by a predetermined angle around the pivot shaft 221, and a coupling member 115 is coupled to the coupling hole (not shown) formed in the pulley 110 at a predetermined position of the positioning hole 230, the cam module 220 is coupled to the pulley 110. When a bolt as the coupling member 115 is inserted into the positioning hole 230 and is screw-coupled into the coupling hole (not shown) formed in the pulley 110, the cam module 220 is coupled to the pulley 110. In addition, a position display part indicated by numbers are provided around the positioning hole 230, in order to display position at which the cam module 220 is fixed. The cam modules 220 that are respectively coupled to the upper and lower pulley assemblies should have an identical rotational angle, and thus the position display part is indicated by numbers so as to see the rotational angle of each cam module 220. In addition, an arc-shaped coupling hole 116 centered at the pivot shaft 221 is additionally formed in the pulley 110, and a bolt 225 is coupled to a bolt hole formed at a predetermined position of the cam module 220.

When considering a lower pulley 110 in order to adjust a draw length of a bowstring 140 at a let-off state in a compound bow 100 illustrated in FIGS. 1 to 3, a bolt 115 engaged in a position adjusting hole 230 of a cam module 220 is removed, and then the cam module 220 is rotated by a predetermined angle around a pivot shaft 221 formed at a position spaced from a rotating shaft 101 of the lower pulley 110 to obtain a user desired draw length of the bowstring 140 at a let-off state. Then, the cam module 220 is fixed to the lower pulley 110 by using the bolt 115 again at the rotated position of the cam module 220, as shown in FIG. 3. In this case, the cam modules 220 respectively coupled to the lower and upper pulleys 110 are moved at an identical rotation angle.

When the cam module 220 is rotated around the pivot shaft 221 by a predetermined angle from the cam cable support portion 210, and the cam module 220 is fixed again to the lower pulley 110 at the rotated position of the cam module 220, as shown in FIG. 3, a winding length of a cam cable 150 wound on a smooth curved portion 222 of the cam module 220 is increased in comparison with FIG. 2. The length of the cam cable 150 wound on the cam module 220 from the cam cable support portion 210 up to the let-off state is eventually increased, to thereby increase a draw length of the bowstring 140.

By the way, in such a conventional compound bow, the cam modules 220 on which the cam cables 150 are wound are respectively coupled to an equi-directional side of the lower and upper pulleys 110, and rotating wheels 120 are respectively mounted more spaced apart from the lower and upper pulleys 110 than the cam modules 220. It is a factor of enlarging distortion of bow limbs 103 and also lowering accuracy of an arrow when the bowstring 140 is pulled that a configuration of the rotating wheels 120 that are respectively coupled to the pulleys 110 is formed higher than a configuration of the cam modules 220 that are respectively coupled to the pulleys 110.

SUMMARY OF THE INVENTION

To solve the above conventional problems or defects, it is an object of the present invention to provide a compound bow that improves stability of the bow while easily adjusting a draw length of a bowstring at a let-off state.

To accomplish the above and other objects of the present invention, according to an aspect of the present invention, there is provided a compound bow comprising: a bow main body including a handle at a central portion of which a grip portion is formed and a pair of limbs that are respectively coupled to both ends of the handle; upper and lower pulley assemblies each including a pulley that is rotatably coupled to a rotating shaft formed on the rear end of each limb, and a cam that is coupled to the pulley and is rotated with the pulley; a bowstring whose either end is wound on and coupled to the pulley of each of the upper and lower pulley assemblies; and first and second cam cables that are wound around the cam of each of the upper and lower pulley assemblies as the bowstring is pulled, in which one end of each of the first and second cam cables is coupled to one of the upper and lower pulley assemblies, and the other end thereof is coupled to the other of the upper and lower pulley assemblies or the rotating shaft of the other of the upper and lower pulley assemblies, wherein the respective cams of each of the pulley assemblies comprise: a cam cable support portion supporting the cam cable; a cam module that is movably coupled in an arc trajectory on the pulley to which the cams are coupled; and a fixing unit that fixes the cam module at a desired position on the pulley in order to adjust a draw length of a let-off state, in which the cam cable is supported on the cam cable support portion and then is wound on the outer circumferential surface of the cam module, when the bowstring is pulled, at least one of the first and second cam cables is coupled to the fixing projection that is formed in the cam module and moves along as the cam module moves, is wound on a cam cable winding portion that is penetrated by the rotating shaft via a compensation projection, and then extends toward the other side pulley assembly, and a front portion of the cam module is in contact with the one cam cable and thus the one cam cable is bent when the cam module is moved in which one end of the one cam cable is coupled to the fixing projection of the cam module in order to adjust the draw length of the let-off state, to thus release the one cam cable from the cam cable winding portion via the compensating projection from the fixing projection that the one cam cable is coupled, to thereby maintain constant tension of the cam cable and keep the power of the bow.

Preferably but not necessarily, the compensating projection is made in a pulley form and is rotatably coupled to the pulley to which the compensating projection is coupled.

Preferably but not necessarily, the cam module is rotatably coupled at a predetermined angle from the cam cable support portion around a pivoting point at a position spaced apart from the rotating shaft of the pulley.

Preferably but not necessarily, an arc-shaped position adjusting hole is formed on the pulley on which the cam module is coupled, and the cam module is movably coupled to the pulley along the position adjusting hole.

As described above, the present invention provides a compound bow capable of improving stability of the bow and maintaining constant power of the bow while easily adjusting a pulling length of the let-off state.

DETAILED DESCRIPTION OF THE PREFERRED EMBODIMENT(S)

The above and/or other objects and/or advantages of the present invention will become more apparent by the following description of embodiments of the present invention.

Hereinbelow, a compound bow according to a first embodiment of the present invention will be described in more detail with reference to the accompanying drawings.

Figure 1:
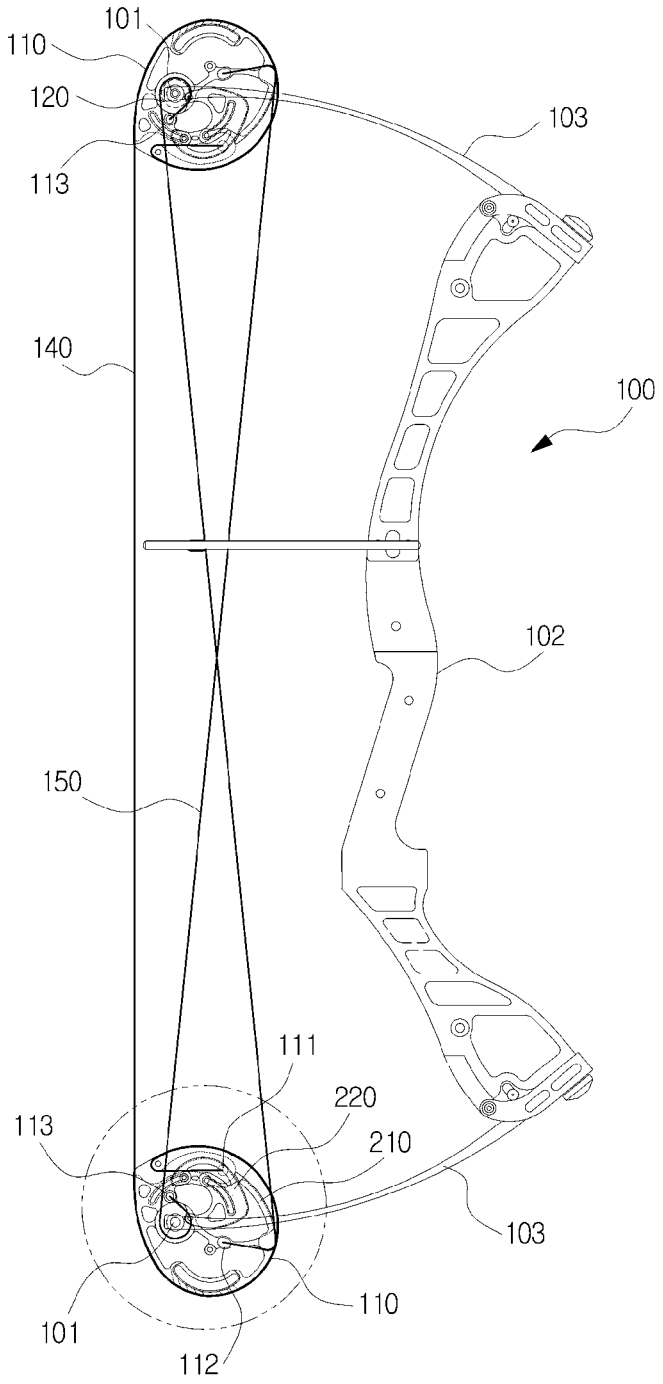
FIG.1 (PRIOR ART)
FIG. 1 is a perspective view of a conventional compound bow.
Figure 2:
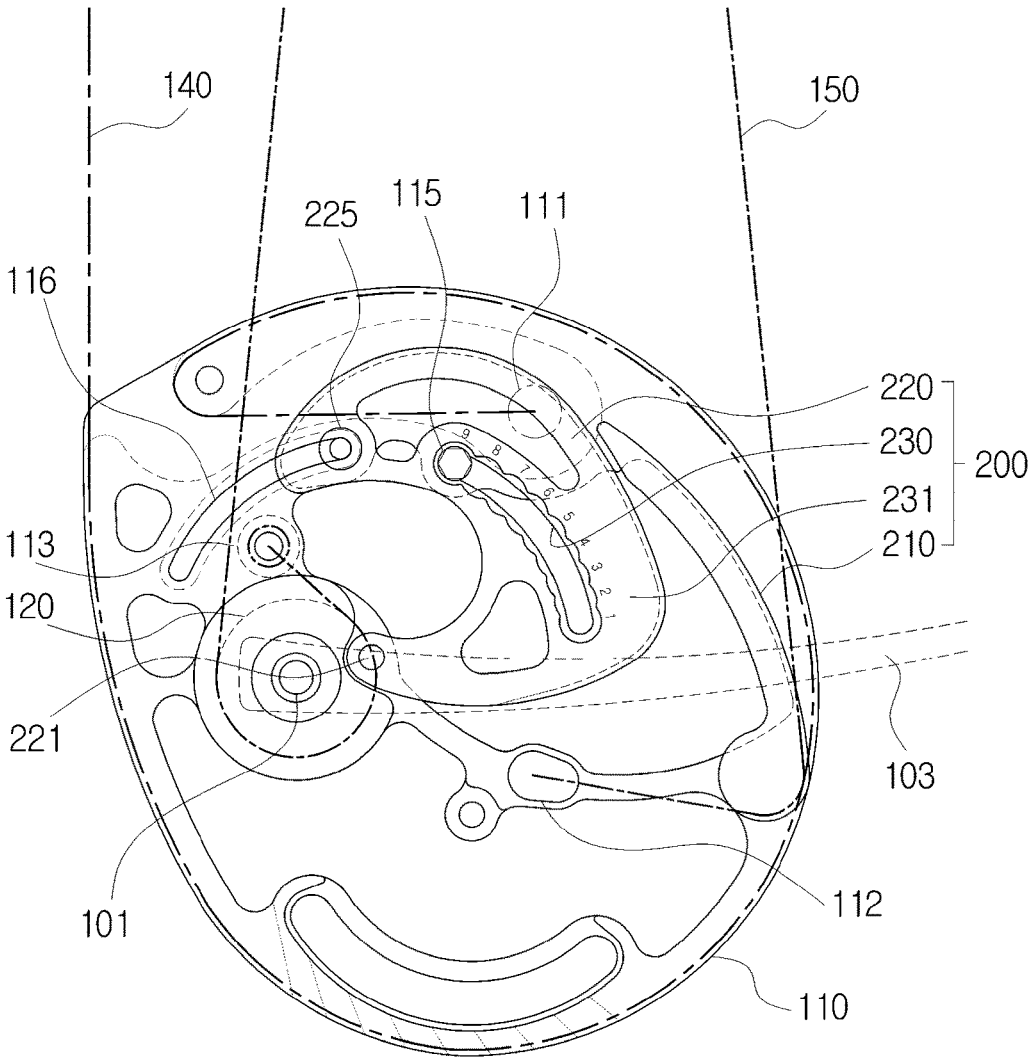
FIG.2 (PRIOR ART)
FIG. 2 is a plan view of a pulley assembly coupled to a lower limb in FIG. 1.
Figure 3:
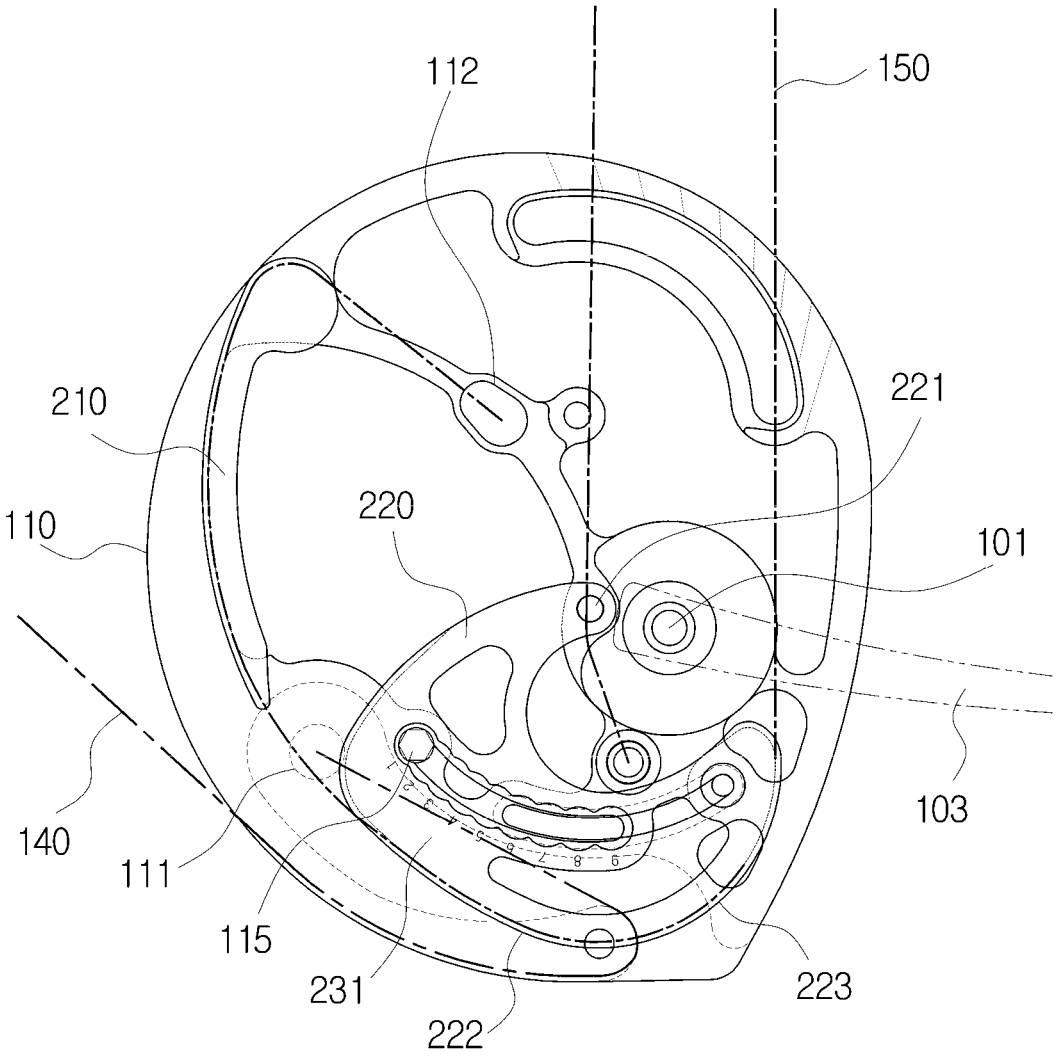
FIG.3 (PRIOR ART)
FIG. 3 is a plan view showing a pivoted state of a cam module in the compound bow of FIG. 1.
Figure 4:
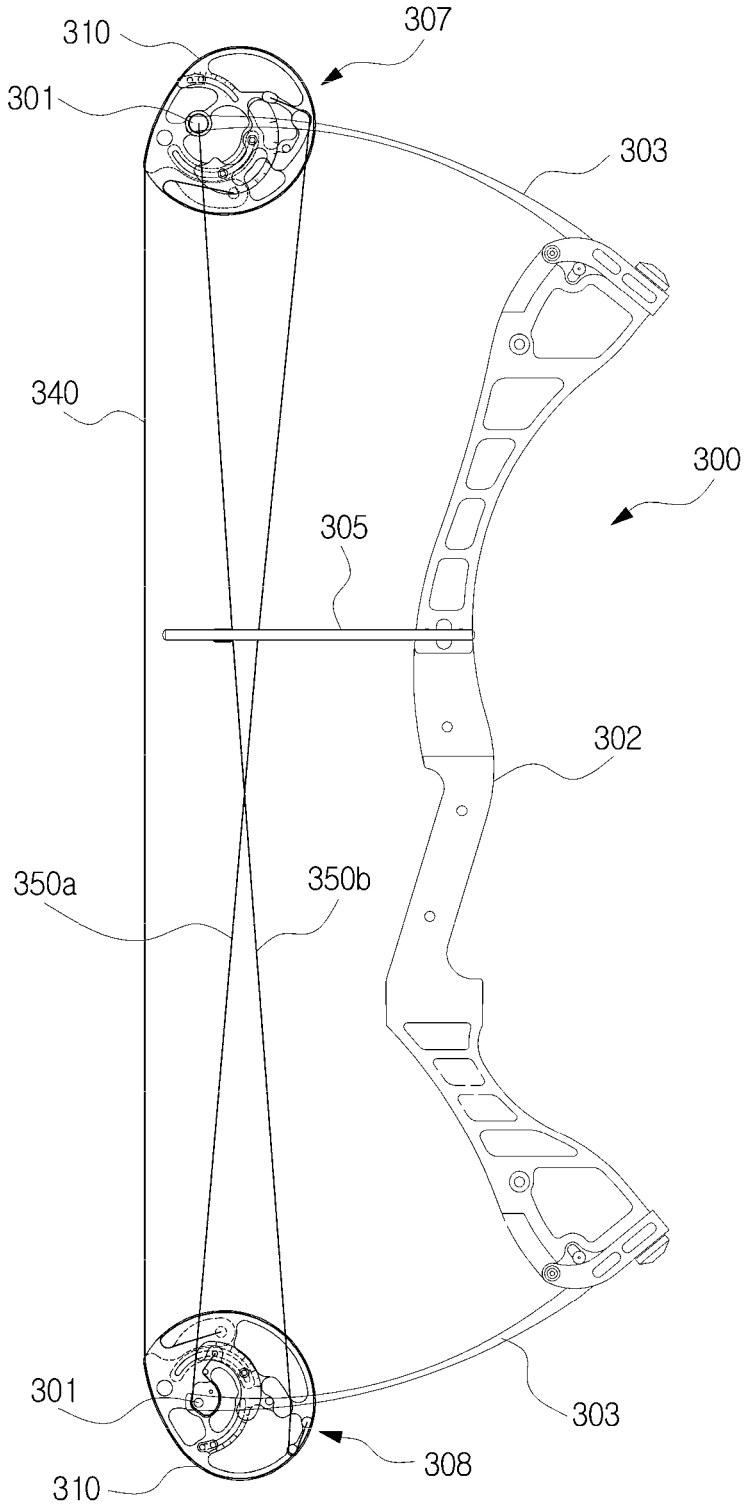
FIG. 4 is a plan view showing a compound bow according to a first embodiment of the present invention.
Figure 5:
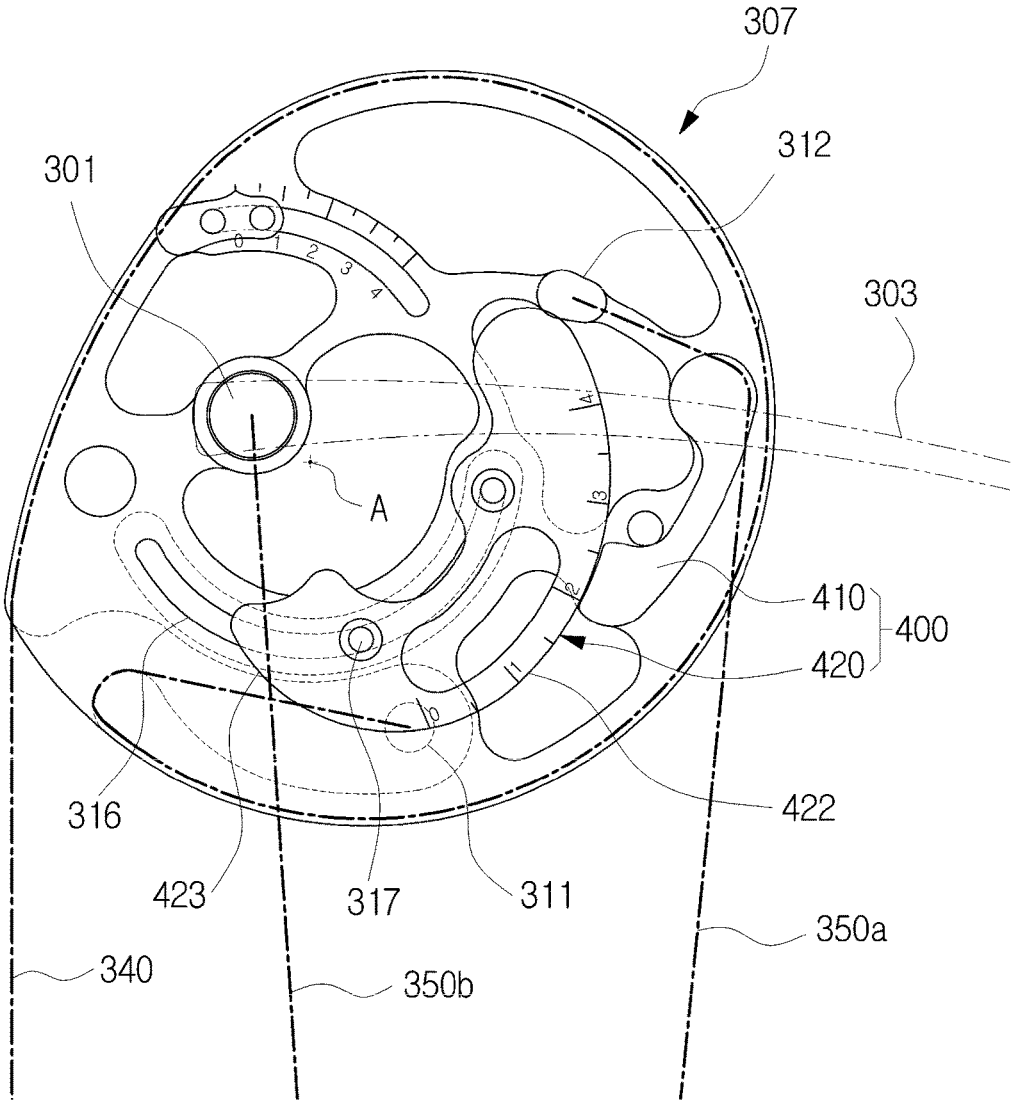
FIG. 5 is a plan view showing an upper pulley assembly coupled to an upper limb of FIG. 4.
Figure 6:
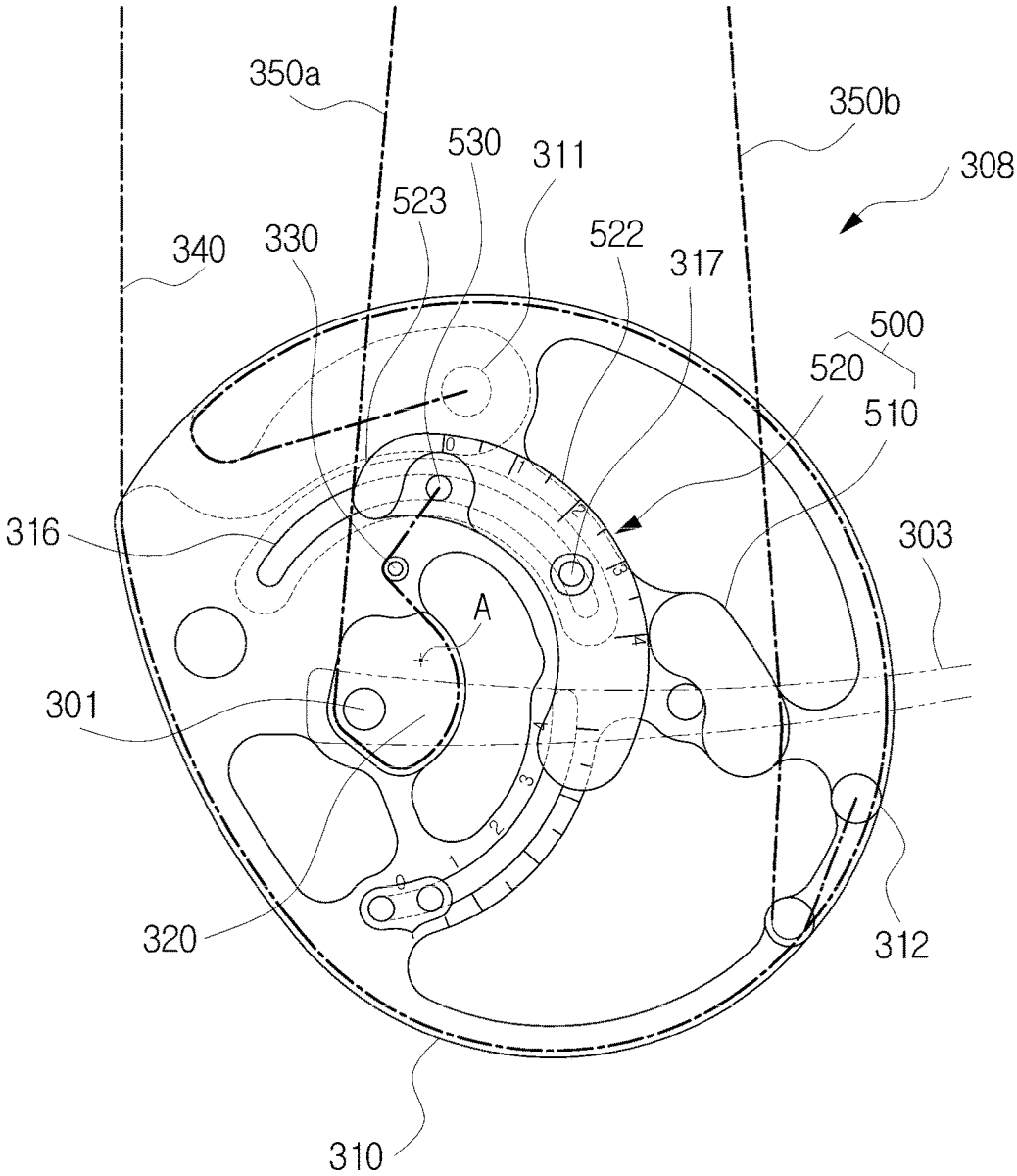
FIG. 6 is a plan view showing a lower pulley assembly coupled to a lower limb of FIG. 4.
Figure 7:
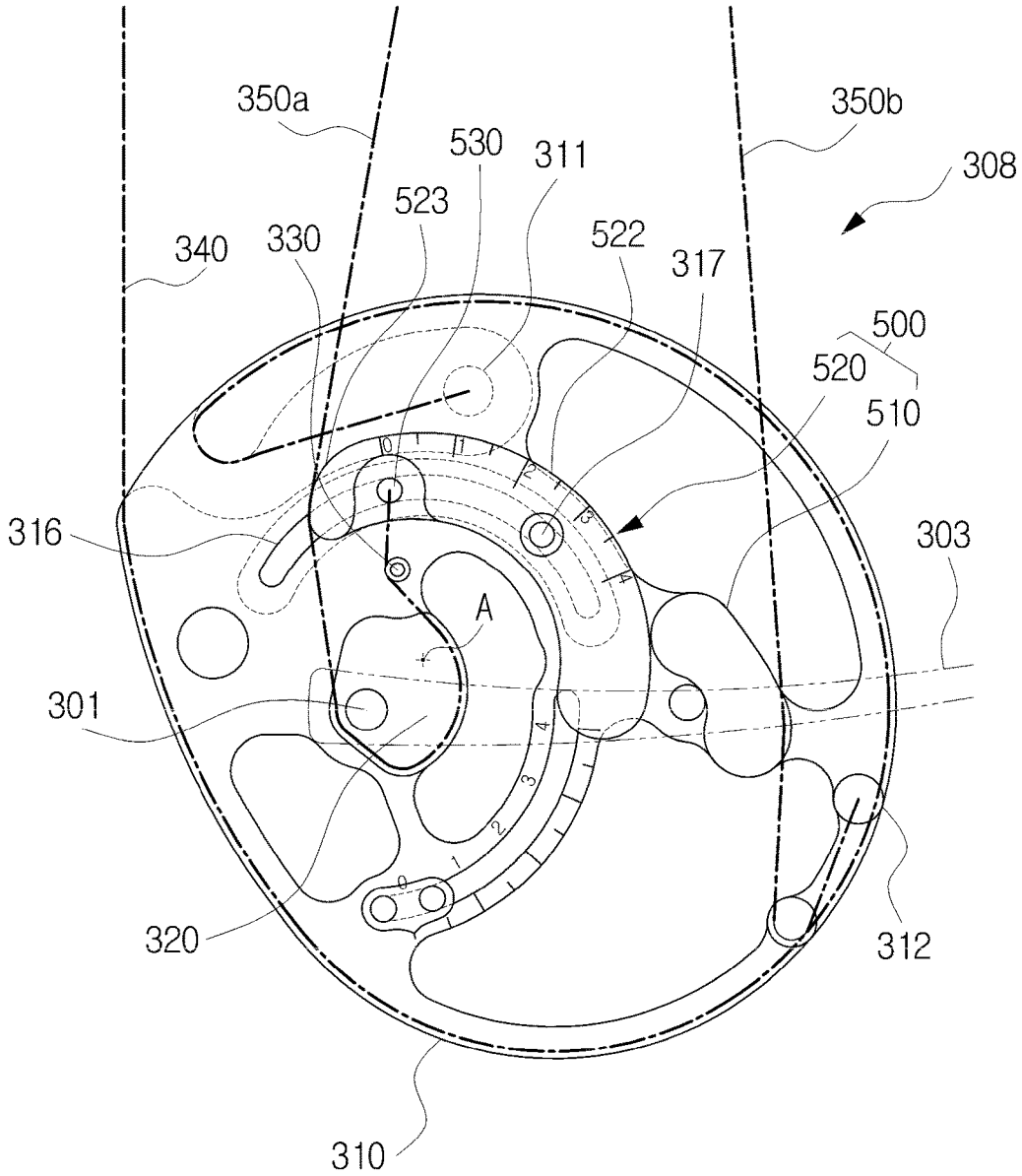
FIG. 7 is a plan view showing a state where the cam module has been rotated in FIG. 6.

FIG. 4 is a plan view showing a compound bow according to a first embodiment of the present invention. FIG. 5 is a plan view showing an upper pulley assembly coupled to an upper limb of FIG. 4. FIG. 6 is a plan view showing a lower pulley assembly coupled to a lower limb of FIG. 4. FIG. 7 is a plan view showing a state where the cam module has been rotated in FIG. 6.

Referring to FIGS. 4 to 7, a compound bow according to a first embodiment of the present invention includes: a bow main body 300 including a pair of limbs 303 that are respectively coupled to both ends of a handle 302; upper and lower pulley assemblies 307 and 308 that are respectively coupled to the rear end of each limb 303; a bowstring 340; first and second cam cables 350*a* and 350*b* that are wound around a cam 400, 500 of each of the upper and lower pulley assemblies 307 and 308 as the bowstring 340 is pulled.

The respective cams of each of the pulley assemblies 307 and 308 comprise a cam cable support portion 410, 510 supporting the cam cable; a cam module 420, 520 that is movably coupled in an arc trajectory on the pulley 310 to which the cams 400, 500 are coupled; and a fixing unit that fixes the cam module 420, 520 at a desired position on the pulley 310 in order to adjust a draw length of a let-off state, in which the cam cable 350*a*, 350*b* is supported on the cam cable support portion 410 or 510 and then is wound on the outer circumferential surface of the cam module 420 or 520, when the bowstring 340 is pulled.

At least one of the first and second cam cables 350*a* and 350*b* is coupled to the fixing projection 530 that is formed in the cam module 420 or 520 and moves along as the cam module moves, is wound on a cam cable winding portion 320 that is penetrated by the rotating shaft 301 via a compensation projection 330, and then extends toward the other side pulley assembly 307 or 308, and a front portion of the cam module 420 or 520 is in contact with the one cam cable and thus the one cam cable is bent when the cam module 420 or 520 is moved in which one end of the one cam cable is coupled to the fixing projection 530 in order to adjust the draw length of the let-off state, to thus release the one cam cable from the cam cable winding portion 320 via the compensating projection 330 from the fixing projection 530 that the one cam cable is coupled, to thereby maintain constant tension of the cam cable and keep the power of the bow.

As shown, the compound bow according to the present invention will be described below in more detail. First, the bow main body 300 includes a handle 302 at a central portion of which a grip portion is formed so as to be gripped by a user, and a pair of limbs 303 that are respectively coupled to both ends of the handle 302 in which two branches are formed at the rear portion of each limb 303. A rotating shaft 301 is formed at the rear end of each limb 303, in which a pulley assembly 307 or 308 is rotatably coupled on the rotating shaft 301 between the two branches at the rear end of each limb 303. A cable guard 305 that pushes the cam cables 350*a* and 350*b* to one side of the bowstring 340 is coupled at the central portion of the handle 302, in order to prevent an arrow from being interrupted during shooting.

Then, each of the upper and lower pulley assemblies 307 and 308 is rotatably coupled to the rotating shaft 301 at the rear end of each limb 303, and includes: a pulley 310 that is rotatably coupled to the rotating shaft 301 formed at the rear end of each limb 303; and a cam 400 or 500 coupled to one side of the pulley 310 and rotating with the pulley 310.

Each pulley 310 is formed of an oval-like plate-shaped member, and has an eccentric through-hole that is formed at the center of the pulley 310 and through which the rotating shaft 301 is coupled. Further, a guide groove that is depressed down to a predetermined depth is formed on the outer circumferential surface of each pulley 310 so that the bowstring 340 may be wound on the outer circumferential surface of each pulley 310. A fixing protrusion 311 for fixing one end of the bowstring 340 wound on the guide groove is formed at one side of each pulley 310. In addition, fixing protrusions 312 are formed in each pulley 310 in which the cam cables 350*a* and 350*b* are fixed to the fixing protrusions 312 respectively.

As shown in FIG. 5, a cam 400 is formed in a pulley 310 of the upper pulley assembly 307 and is rotated with rotation of the pulley 310, and includes: a cam cable support portion 410 fabricated in an arc-shaped form and on which the first cam cable 350*a* is wound; and a cam module 420 that is rotatably coupled by a predetermined angle from the cam cable support portion 410, around a pivot point "A" at a position spaced by a predetermined distance from a rotating shaft 301 of the pulley 310 to which the cam 400 is coupled, in which a cam cable winding groove is formed on the outer circumferential surface of the cam module 420, and the first cam cable 350*a* is wound around the cam cable support portion 410 and then sequentially wound on the outer circumferential surface of the cam module 420 when the bowstring 340 is pulled.

The cam cable support portion 410 is arc-shaped so that the first cam cable 350*a* is wound on the cam cable support portion 410, when the bowstring 340 is pulled, in which the first cam cable 350*a* is coupled to the fixing protrusions 312 that is located in the vicinity of the cam cable support portion 410. In addition, a cam cable winding groove is formed on the outer circumferential surface of the cam cable support portion 410 so that the first cam cable 350*a* is wound on the outer circumferential surface of the cam cable support portion 410.

The cam module 420 is rotatably coupled by a predetermined angle from the cam cable support portion 410, around a pivot point "A" at a position spaced by a predetermined distance from a rotating shaft 301 of the pulley 310 to which the cam 400 is coupled, and is configured to have a gentle slope portion 422 formed of a gentle arc-shaped curve and a steep slope portion 423 that is extended from the gentle slope portion 422 to be close to the rotating shaft 301, to thus form a steep slope. Further, a cam cable winding groove on which the first cam cable 350*a* is wound is formed on the outer circumferential surfaces of the gentle slope portion 422 and the steep slope portion 423. Accordingly, the cam module 420 is rotated along with the pulley 310 when the bowstring 340 is pulled, and thus the first cam cable 350*a* is sequentially wound on the gentle slope portion 422 and the steep slope portion 423 of the cam module 420 adjacent to the cam cable support portion 410.

In addition, the cam 400 further includes a fixing unit that makes the cam module 420 rotated by a predetermined angle with respect to the pivot point "A" in order to control the draw length of the let-off state of the compound bow, and that makes the cam module 420 fixed to the pulley 310 at a position where the cam module 420 has been rotated.

The fixing unit makes the cam module 420 fixed to the pulley 310 at a position where the cam module 420 has been rotated. To this end, an arc-shaped position adjusting hole 316 centered at the pivot point "A" is formed in the pulley 310 to which the cam module 420 is coupled, and two coupling holes is formed in the cam module 420. Thus, when the cam module 420 is rotated by a predetermined angle around the pivot point "A", a bolt 317 inserted to the coupling hole formed in the cam module 420 and the position adjusting hole 316 is screw-coupled to a nut (not shown). In addition, a position display part indicated by numbers are provided in the periphery of the cam module 420, in order to display position at which the cam module 420 is fixed.

As shown in FIG. 6, a cam 500 is formed in a pulley 310 of the lower pulley assembly 308 and is rotated with rotation of the pulley 310, and includes: a cam cable support portion 510 fabricated in an arc-shaped form and on which the second cam cable 350*b* is wound; and a cam module 520 that is rotatably coupled by a predetermined angle from the cam cable support portion 510, around a pivot point "A" at a position spaced by a predetermined distance from a rotating shaft 301 of the pulley 310 to which the cam 500 is coupled, in which a cam cable winding groove is formed on the outer circumferential surface of the cam module 520, and the second cam cable 350*b* is wound around the cam cable support portion 510 and then sequentially wound on the outer circumferential surface of the cam module 520 when the bowstring 340 is pulled.

The cam cable support portion 510 is arc-shaped so that the second cam cable 350*b* is wound on the cam cable support portion 510, when the bowstring 340 is pulled, in which the second cam cable 350*b* is coupled to the fixing protrusions 312 that is located in the vicinity of the cam cable support portion 510. In addition, a cam cable winding groove is formed on the outer circumferential surface of the cam cable support portion 510 so that the second cam cable 350*b* is wound on the outer circumferential surface of the cam cable support portion 510.

The cam module 520 of the lower cam 500 is rotatably coupled by a predetermined angle from the cam cable support portion 510, around a pivot point "A" at a position spaced by a predetermined distance from a rotating shaft 301 of the pulley 310 to which the cam 500 is coupled, and is configured to have a gentle slope portion 522 formed of a gentle arc-shaped curve and a steep slope portion 523 that is extended from the gentle slope portion 522 to be close to the rotating shaft 301, to thus form a steep slope. Further, a cam cable winding groove on which the second cam cable 350*b* is wound is formed on the outer circumferential surfaces of the gentle slope portion 522 and the steep slope portion 523. Accordingly, the cam module 520 is rotated along with the pulley 310 when the bowstring 340 is pulled, and thus the second cam cable 350*b* is sequentially wound on the gentle slope portion 522 and the steep slope portion 523 of the cam module 520 adjacent to the cam cable support portion 510.

In addition, the cam 500 further includes a fixing unit that makes the cam module 520 rotated by a predetermined angle with respect to the pivot point "A" in order to control the draw length of the let-off state of the compound bow, and that makes the cam module 520 fixed to the pulley 310 at a position where the cam module 520 has been rotated.

The fixing unit makes the cam module 520 fixed to the pulley 310 at a position where the cam module 520 has been rotated. To this end, an arc-shaped position adjusting hole 316 centered at the pivot point "A" is formed in the pulley 310 to which the cam module 520 is coupled, and a coupling hole is formed in the cam module 520. Thus, when the cam module 520 is rotated by a predetermined angle around the pivot point "A", a bolt 317 inserted to the coupling hole formed in the cam module 520 and the position adjusting hole 316 is screw-coupled to a nut (not shown). In addition, a position display part indicated by numbers are provided in the periphery of the cam module 520, in order to display position at which the cam module 520 is fixed.

The cam modules 420 and 520 having such a structure in the present invention can adjust the draw length of the bowstring 340. Thus, when the cam module 420 and 520 of the upper and lower pulley assemblies 307 and 308 is identically rotated by an identical angle from the cam cable support portions 410 and 510 around the pivot point "A" and the cam modules 420 and 520 are again secured to the pulley 310 at a position where the cam module 420 and 520 have been rotated, the length of the first and second cam cables 350*a* and 350*b* that is wound on the gentle slope portion 422 and 522 of the cam modules 420 and 520 increases in comparison with the previous embodiment. At last, the length of the first and second cam cables 350*a* and 350*b* that is wound from the cam cable support portion 410 and 510 to the cam module 420 and 520 until the let-off state increases, to thereby increase the draw length of the bowstring 340.

The bowstring 340 is wound in the guide groove of the pulley 310 of each pulley assembly 307 or 308 and thus both ends of the bowstring 340 are coupled to the fixing protrusions 311 formed on the respective pulleys 310.

The first and second cam cables 350*a* and 350*b* are formed between a pair of limbs 303, and are wound on cams 400 and 500 formed on respective pulleys 310 as a bowstring 340 is pulled. First, one end of the second cam cable 350*b* is coupled to a rotating shaft 301 of the upper pulley assembly 307 as buss cable type and the other end of the second cam cable 350*b* is coupled to the fixing protrusions 312 of the lower pulley 310.

One end of the first cam cable 350*a* is coupled to the fixing projection 312 formed on the pulley 310 of the upper pulley assembly 307, and extends to the lower pulley assembly 308. Then, as shown in FIG. 6, the first cam cable 350*a* is wound around a cam cable winding portion 320 that is formed on the lower pulley 310 and through which the rotating shaft 301 is penetrated, and then the other end of the first cam cable 350*a* is fixed on a fixing projection 530 that is formed on the lower cam module 520 via a compensating projection 330.

The cam cable winding portion 320 is formed on one side of the lower pulley 310 to which the cam module 520 is coupled, and the rotating shaft 301 penetrates the cam cable winding portion 320. A cable winding groove on which the first cam cable 350*a* is wound is formed on the outer circumferential surface of the cam cable winding portion 320, and part of the outer circumferential surface of the cam cable winding portion 320 is formed in an arc shape.

The compensating projection 330 is formed between the cam cable winding portion 320 and a fixing projection 530 of the cam module 520, and an end of the first cam cable 350*a* is coupled to the fixing projection 530 of the cam module 520 via the compensating projection 330 from the cam cable winding portion 320. The compensating projection 330 is made up in a pulley form to then be rotatably coupled to the lower pulley 310, thereby reducing the friction between the cam cable and the compensating projection 330 when moving the cam module for adjustment of the draw length.

When describing the operation of the compound bow according to the first embodiment of the present invention having the configuration described above, bolts 317 to secure the cam modules 420 and 520 of the upper and lower pulley assemblies 307 and 308 to the pulleys 310 are loosened to thus release the fixed states of the cam modules 420 and 520. At the state where the fixed states of the cam modules 420 and 520 have been released, the cam modules 420 and 520 of the upper and lower pulley assemblies 307 and 308 are moved to desired positions from cam cable support portions 410 and 510 along position adjusting holes 316, respectively, and then the cam modules 420 and 520 are fixed to the respective pulleys 310 via the bolts 317. In this case, the lengths of the first and second cam cables 350*a* and 350*b* wound on smooth curved portions 422 and 522 of the cam modules 420 and 520 are increased, and thus the lengths of the first and second cam cables 350*a* and 350*b* wound on the cam modules 420 and 520 from the cam cable support portions 410 and 510 up to a let-off state are eventually increased to thereby finally increase the draw lengths of the first and second cam cables 350*a* and 350*b*.

In the case of the cam module 520 of the lower pulley assembly 308, when the cam module 520 is moved in the forward direction along the position adjusting hole 316, the cam cable winding portion 320 is positioned on the same plane as the cam module 520, and thus the first cam cable 350*a* is bent by the cam module 520 as shown in FIG. 7, at a state where the first cam cable 350*a* is in contact with the front portion of the cam module 520. When the first cam cable 350*a* is bent, tension of the first cam cable 350*a* becomes strong to thus finally change the power of the bow. It is not desirable to users who use the compound bow to change the power of the bow. In the present invention, the first cam cable 350*a* is coupled to the fixing projection 530 of the cam module 520 via the compensating projection 330 from the cam cable winding portion 320. Thus, when the cam module 520 is moved in the forward direction, the fixing projection 530 of the cam module 520 is also moved in the forward direction. As a result, the first cam cable 350*a* is unwound in the direction of the upper pulley assembly 307 from the cam cable winding portion 320 via the compensating projection 330 from the cam module 520. Therefore, even though the first cam cable 350*a* is bent by the cam module 520, tension of the first cam cable 350*a* is consistently maintained and thus the power of the bow is also kept constant.

Further, in some embodiments of the present invention, since the cam cable winding portion 320 is positioned on the same plane as the cam module 520, twisting of the bow limbs 303 is minimized to thereby improve stability of the bow, as the bowstring 340 is pulled.

Therefore, the compound bow according to the embodiment of the present invention can easily control the draw length, keep the power of the bow constant, and minimize twisting of the bow limbs 303, to thereby exhibit inherent strength of the bow and improve accuracy of an arrow.

Figure 8:
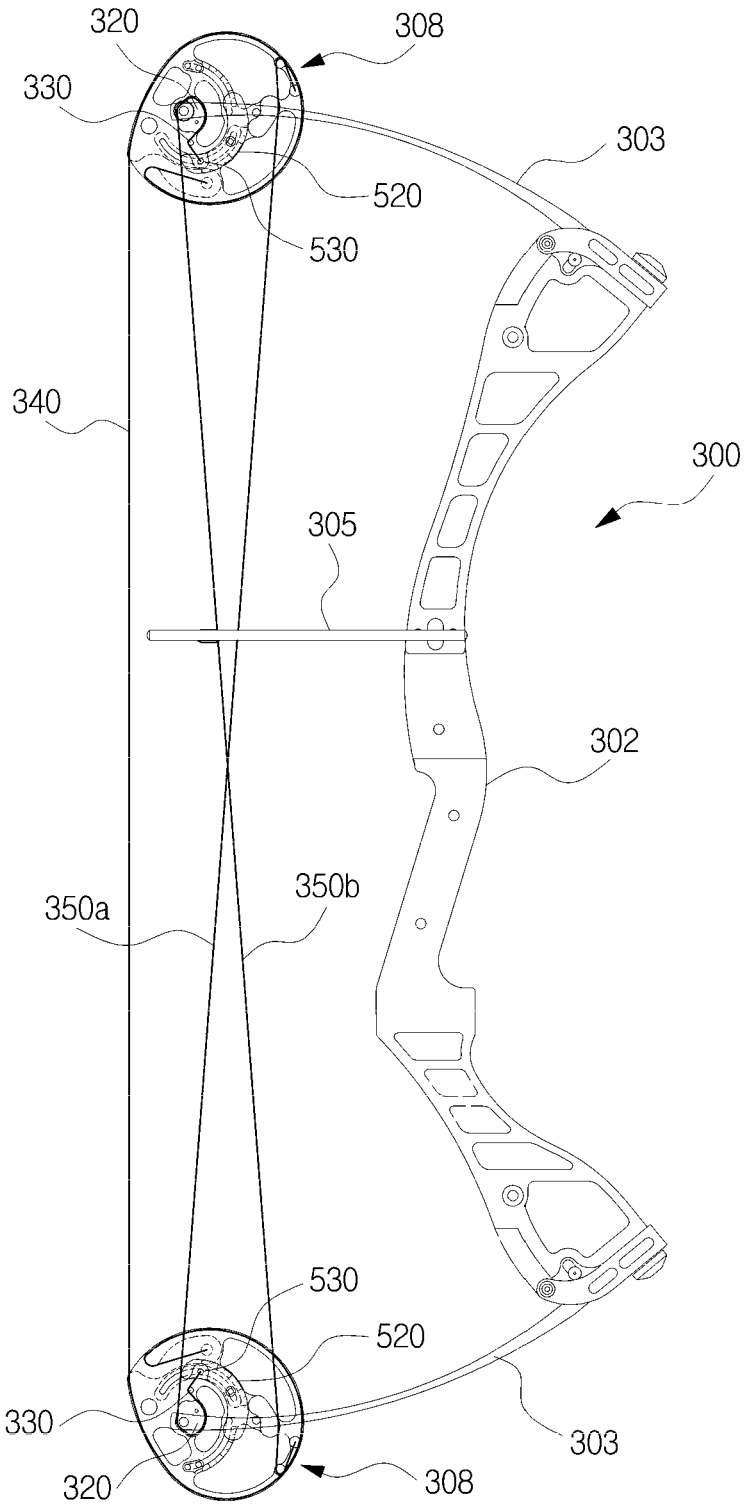
FIG. 8 is a plan view showing a compound bow according to a second embodiment of the present invention.

Meanwhile, FIG. 8 shows a compound bow according to a second embodiment of the present invention. The compound bow according to the second embodiment shows an example of being applied to a dual cam system. The compound bow of the second embodiment differs from that of the first embodiment in that the upper and lower pulley assemblies are configured to have a vertically symmetric mirror image in the second embodiment. In other words, the configuration of the upper and lower pulley assemblies in the second embodiment is the same as that of the lower pulley assembly 308 in the first embodiment.

Therefore, one end of the first and second cam cable 350*a* and 350*b* is coupled to the fixing projection 312 formed on the pulley 310 of the one of the upper and lower pulley assemblies 307 and 308, and extends to the other of the upper and lower pulley assemblies 307 and 308. Then, as shown in FIG. 8, each of the first and second cam cable 350*a* and 350*b* is wound around a cam cable winding portion 320 that is formed on the pulley 310 of the other of the upper and lower pulley assemblies 307 and 308, and then the other end of the first and second cam cable 350*a* and 350*b* is fixed on a fixing projection 530 that is formed on the cam module 520 via a compensating projection 330.

Thus, even in the case of the second embodiment of the present invention that can be applied to a compound bow of a dual cam system, the draw length can be easily adjusted identically to the first embodiment, to thus maintain the power of the bow, and improve stability of the bow. Since other configurations and operational effects of the second embodiment are the same as those of the first embodiment, the detailed description thereof will be omitted here.

As described above, the present invention has been described with respect to particularly preferred embodiments such as one and half cams or a dual cam. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. A compound bow comprising:

a bow main body including a handle at a central portion of which a grip portion is formed and a pair of limbs that are respectively coupled to both ends of the handle;

upper and lower pulley assemblies each including a pulley that is rotatably coupled to a rotating shaft formed on the rear end of each limb, and a cam that is coupled to the pulley and is rotated with the pulley;

a bowstring whose either end is wound on and coupled to the pulley of each of the upper and lower pulley assemblies; and first and second cam cables that are wound around the cam of each of the upper and lower pulley assemblies as the bowstring is pulled, in which one end of each of the first and second cam cables is coupled to one of the upper and lower pulley assemblies, and the other end thereof is coupled to the other of the upper and lower pulley assemblies or the rotating shaft of the other of the upper and lower pulley assemblies, wherein the respective cams of each of the pulley assemblies comprise: a cam cable support portion supporting, the cam cable; a cam module that is movably coupled in an arc trajectory on the pulley to which the cams are coupled; and a fixing unit that fixes the cam module at a desired position on the pulley in order to adjust a draw length of a let-off state, in which the cam cable is supported on the cam cable support portion and then is wound on the outer circumferential surface of the cam module, when the bowstring is pulled, at least one of the first and second cam cables is coupled to a fixing projection that is formed in the cam module and moves along as the cam module moves, is wound on a cam cable winding portion that is penetrated by the rotating shaft via a compensation projection, and then extends toward the other side pulley assembly, and a front portion of the cam module is in contact with the one cam cable and thus the one cam cable is bent when the cam module is moved in which one end of the one cam cable is coupled to the fixing projection of the cam module in order to adjust the draw length of the let-off state, to thus release the one cam cable from the cam cable winding portion via the compensating projection from the fixing projection that the one cam cable is coupled, to thereby maintain constant tension of the cam cable and keep the power of the bow.

2. The compound bow of claim 1, wherein the compensating projection is made in a pulley form and is rotatably coupled to the pulley to which the compensating projection is coupled.

3. The compound bow of claim 1, wherein the cam module is rotatably coupled at a predetermined angle from the cam cable support portion around a pivoting point at a position spaced apart from the rotating shaft of the pulley.

4. The compound bow of claim 3, wherein an arc-shaped position adjusting hole is formed on the pulley on which the cam module is coupled, and the cam module is movably coupled to the pulley along the position adjusting hole.

* * * * *